US007273272B2

(12) United States Patent
Inoue

(10) Patent No.: US 7,273,272 B2
(45) Date of Patent: Sep. 25, 2007

(54) LIQUID SUPPLY DEVICE AND IMAGE FORMING APPARATUS

(75) Inventor: Hiroshi Inoue, Kanagawa (JP)

(73) Assignee: Fuji Photo Film Co., Ltd., Minami-Ashigara-shi (JP)

( * ) Notice: Subject to any disclaimer, the term of this patent is extended or adjusted under 35 U.S.C. 154(b) by 362 days.

(21) Appl. No.: 11/083,973

(22) Filed: Mar. 21, 2005

(65) Prior Publication Data

US 2005/0206696 A1 Sep. 22, 2005

(30) Foreign Application Priority Data

Mar. 22, 2004 (JP) ..... 2004-083061

(51) Int. Cl.
*B41J 2/175* (2006.01)
*B41J 2/17* (2006.01)

(52) U.S. Cl. ..... 347/85; 347/84

(58) Field of Classification Search ..... 347/85, 347/84, 19, 30, 40, 18; 137/595, 863, 240; 604/5.01

See application file for complete search history.

(56) References Cited

U.S. PATENT DOCUMENTS 3,411,534 A * 11/1968 Rose ..... 137/595
3,533,439 A * 10/1970 Hall ..... 137/595
4,121,622 A * 10/1978 Forberg ..... 137/863
6,139,136 A * 10/2000 Mackay et al. ..... 347/85
6,364,449 B1 4/2002 Takahashi et al.
6,540,340 B2 * 4/2003 Thorpe et al. ..... 347/85
6,843,779 B1 * 1/2005 Andrysiak et al. ..... 604/5.01
6,951,378 B1 * 10/2005 Yamada et al. ..... 347/18
2003/0132980 A1 * 7/2003 Yamazaki et al. ..... 347/19
2004/0141023 A1 * 7/2004 Nakamura ..... 347/30
2004/0159351 A1 * 8/2004 Znamensky et al. ..... 137/240
2005/0093922 A1 * 5/2005 McGarry et al. ..... 347/40

FOREIGN PATENT DOCUMENTS

JP 10-244681 A 9/1998
JP 2000-153622 A 6/2000
JP 2003-118135 A 4/2003

* cited by examiner

*Primary Examiner*—Hai Pham
*Assistant Examiner*—Carlos A. Martinez, Jr.
(74) *Attorney, Agent, or Firm*—Birch, Stewart, Kolasch, & Birch, LLP

(57) ABSTRACT

The liquid supply device supplies ejection liquid to a plurality of ejection heads from a liquid tank, and comprises: a supply pipe which connects the liquid tank to the plurality of ejection heads, an upstream end portion of the supply pipe being connected to the liquid tank, a downstream side of the supply pipe being branched into a plurality of branch pipes having different numbers of branches by means of a plurality of ramifying sections, ends of the plurality of branch pipes being respectively connected to the plurality of ejection heads; and a flow path resistance altering device which alters a flow path resistance in at least one of flow paths from the plurality of ramifying sections to the plurality of ejection heads, wherein branch pipes having a relatively small number of branches among the plurality of branch pipes are connected to ejection heads having a relatively high ejection frequency among the plurality of ejection heads.

11 Claims, 13 Drawing Sheets

LIQUID SUPPLY DEVICE AND IMAGE FORMING APPARATUS

BACKGROUND OF THE INVENTION

1. Field of the Invention

The present invention relates to a liquid supply device and an image forming apparatus, and more particularly to a liquid supply device and an image forming apparatus using the liquid supply device suitable for supplying a liquid for ejection to a multiple head formed to a long dimension by joining together ejection heads having nozzle rows.

2. Description of the Related Art

In the field of inkjet printers, a composition using a line head having a nozzle row of a length corresponding to the full width of the recording medium (a so-called "full line head") is known in order to achieve high-speed printing, or the like. In general, when an inkjet head is formed as a line head, it becomes difficult to supply ink along a single long dimension. Therefore, it has been thought to improve liquid supply performance by joining together short heads in order to form a long dimension head, and dividing up the flow path to correspond to each short head unit.

In this case, if supply pipes are formed in parallel for the head units from a main tank forming a liquid supply source, then it is necessary to provide the same number of supply pipes as the number of heads, and this gives rise to layout problems. As a means for avoiding such problems, it has been thought to branch off-the-supply tubes at intermediate positions.

In this respect, Japanese Patent Application Publication No. 10-244681 discloses flow path connection configurations for cases where there are a plurality of nozzle unit elements (short heads), and respective connection configurations involving serial arrangement, parallel arrangement or a combination of these arrangements. However, Japanese Patent Application Publication No. 10-244681 simply proposes connection methods, and does not disclose which flow path configuration would be suitable under which conditions.

Japanese Patent Application Publication No. 2003-118135 discloses a method where, in order to supply liquid to a plurality of heads from one main tank, the tank is connected to the heads by repeated branches based on two-branch joints. However, in the case of Japanese Patent Application Publication No. 2003-118135, it is necessary to provide repeated branches in a symmetrical fashion in order to equalize the pressure loss at each print head. Consequently, there are very significant restrictions on the layout. Moreover, the method described in Japanese Patent Application Publication No. 2003-118135 also entails a problem in that it cannot be applied to an odd number of heads.

Japanese Patent Application Publication No. 2000-153622 discloses a composition in which a flow path resistance altering device is provided in the course of a tube which connects a cap unit used in a cleaning operation for restoring the ejection performance of an inkjet head to a plurality of pumps. Japanese Patent Application Publication No. 2000-153622 relates to flow paths for ink removal, and it achieves reductions in maintenance and initial refill times, simplification and improved performance of the pump unit, and compactification of the apparatus. However, it does not describe the features of a flow path system for supplying ink to a plurality of heads.

SUMMARY OF THE INVENTION

The present invention has been contrived in view of such circumstances, and an object thereof is to provide a liquid supply device and an image forming apparatus using same which can supply liquid uniformly to a plurality of heads, while also increasing freedom in layout.

In order to attain the aforementioned object, the present invention is directed to a liquid supply device which supplies ejection liquid to a plurality of ejection heads from a liquid tank, comprising: a supply pipe which connects the liquid tank to the plurality of ejection heads, an upstream end portion of the supply pipe being connected to the liquid tank, a downstream side of the supply pipe being branched into a plurality of branch pipes having different numbers of branches by means of a plurality of ramifying sections, ends of the plurality of branch pipes being respectively connected to the plurality of ejection heads; and a flow path resistance altering device which alters a flow path resistance in at least one of flow paths from the plurality of ramifying sections to the plurality of ejection heads, wherein branch pipes having a relatively small number of branches among the plurality of branch pipes are connected to ejection heads having a relatively high ejection frequency among the plurality of ejection heads.

According to the present invention, a supply pipe forming a flow path for sending an ejection liquid to a plurality of ejection heads from a liquid tank storing a liquid has a plurality of ramifying sections, and ramifying is repeated in a stepwise fashion from the upstream side of the supply pipe toward the downstream side. One end portion of the supply pipe (the upstream end) is connected to the liquid tank, and the other end (the downstream end) is divided into a plurality of branch pipes according to the ramifying method or number of branches, each of these branch pipes being connected respectively to an ejection head.

When designing the apparatus, the differences between the ejection frequencies of the plurality of ejection heads are envisaged, or the differences between the ejection frequencies of the plurality of ejection heads are ascertained from the results of actually using an apparatus. Since the flow path resistance tends to become larger, the greater the number of branches in the supply pipe, in the present invention, branch pipes having a smaller number of branches are connected to ejection heads having a higher ejection frequency, whereas branch pipes having a larger number of branches are connected to ejection heads having a lower ejection frequency.

Furthermore, since it is possible to adjust the amount of liquid supplied to each ejection head or the supply pressure at each head, by means of a flow path resistance altering device disposed in at least one of the flow paths to the respective ejection heads, after the branches formed by the ramifying sections, then, for example, supply of liquid can be halted by closing the flow path of the supply pipe in ejection heads which are not ejecting liquid, or alternatively, the supply pressure can be controlled to a substantially uniform pressure in respective ejection heads which are being used simultaneously.

Thereby, it becomes possible to supply liquid appropriately to each ejection head in accordance with the number of ejection heads in use, and hence improvement in the liquid supply speed and improvements in stable supply and refilling response can be achieved. Furthermore, by improving refilling characteristics in this way, it becomes possible to use a higher ejection frequency and to eject liquid of higher viscosity, than in the prior art. Furthermore, the present invention may also be applied to an odd number of ejection heads (such as three ejection heads), and hence the freedom of layout is increased in comparison with a conventional composition.

Here, the "liquid tank" may be a base tank (main tank) forming a liquid supply source or it may be a subsidiary tank which accumulates liquid supplied from a main tank.

In the present invention, a composition may be adopted in which a "flow path resistance altering device" is provided respectively upstream of each ejection head, or a composition may be adopted in which a smaller number of flow path resistance altering devices are provided than the number of ejection heads. By adopting a mode where a flow path resistance altering device is provided respectively upstream of each ejection head, it is possible to adjust the flow path resistance of the supply pipe to each ejection head, individually. On the other hand, even if flow path resistance altering devices are not necessarily provided upstream of all of the ejection heads, by controlling the flow path resistance altering devices upstream of the other ejection heads, it is possible to adjust the amount of liquid supplied and the supply pressure, indirectly, at an ejection head where no flow path resistance altering device is provided. Desirably, the amount of liquid supplied is uniform upon initial filling, and desirably, the supply pressure is uniform during ejection.

Preferably, the branch pipe having a smallest number of branches by means of the ramifying sections among the plurality of branch pipes is connected to the ejection head having a highest ejection frequency among the plurality of ejection heads. It is desirable that the branch pipe having the smallest number of branches is connected to the ejection head having the highest ejection frequency, and branch pipes having larger number of branches are connected to ejection heads having lower ejection frequency.

Preferably, each of the plurality of ejection heads has a plurality of nozzles forming liquid ejection ports; and a line head having a long nozzle row is constituted by aligning the plurality of ejection heads.

The liquid supply device according to the present invention may be used suitably as a liquid supply device for respective ejection heads (head blocks) in a case where a long line head is constituted by joining together a plurality of relatively short ejection heads.

Preferably, the ejection head having the highest ejection frequency is disposed in a central portion of an arrangement of the plurality of ejection heads forming the line head.

For example, in the case of a center-based alignment system, in which the center of the ejectable width in the direction of extension of the line head (the lengthwise direction of the head) substantially coincides with the center of the ejection receiving medium in the lateral direction, it is surmised that the ejection frequency is high in the center region of the line head and that the ejection frequency is low in either side region. Furthermore, if the width dimension of the ejection receiving medium varies, then there may be cases where a small size ejection receiving medium is used and where no liquid is ejected from either side region of the line head. From this standpoint also, an ejection head having a high ejection frequency is located in the center region of the line head.

Alternatively, the ejection head having the highest ejection frequency is disposed in one end portion of an arrangement of the plurality of ejection heads forming the line head.

For example, in the case of a side-alignment system, in which one end of the ejectable width in the direction of extension of the line head (the lengthwise direction of the head) substantially coincides with the one end of the ejection receiving medium in the lateral direction, it is surmised that the ejection frequency is high in the one side region of the line head and that the ejection frequency is low in other side region. In particular, if the width dimension of the ejection receiving medium varies, then there may be cases where a small size ejection receiving medium is used and where no liquid is ejected from the side region of the line head opposite to the side used as a reference for aligning the ejection receiving medium. From this standpoint, an ejection head having a high ejection frequency is disposed in one end portion of the line head (namely, the side including the reference end used to align the ejection receiving medium).

Preferably, the liquid supply device further comprises: a pressure measuring device which is arranged in the branch pipe after a branch by means of the ramifying section and upstream of the ejection head; and a flow path resistance control device which controls the flow path resistance altering device according to a measurement result of the pressure measuring device in such a manner that supply pressures of the plurality of ejection heads are substantially equal to each other. It is desirable that the supply pressure at each of the ejection heads is adjusted while monitoring the pressure by means of a pressure measuring device. According to the present invention, it is possible to achieve uniform liquid supply at each ejection head, while also increasing freedom of layout.

Preferably, the flow path resistance control device controls the flow path resistance altering device so as to close at least one of the flow paths to at least one of the plurality of ejection heads that is not ejecting the liquid.

By implementing control in order to select the ejection head or heads to be used in liquid ejection, in accordance with the size of the ejection receiving medium, it is possible to specify ejection heads that are not to be used in ejection. By controlling the flow path resistance in such a manner that the liquid supply paths to ejection heads which are not ejecting liquid are completely closed off, it is possible to suppress wasteful consumption of liquid. Furthermore, if unintended circumstances arise, such as a momentary power interruption, or if the ejection receiving medium makes contact with the ejection surface of the ejection head due to a conveyance abnormality of the ejection receiving medium (jamming), for instance, then liquid is not expelled unnecessarily from the ejection heads whose liquid supply paths have been closed off by the flow path resistance altering devices. Therefore, safety is improved.

Preferably, the flow path resistance altering device comprises a mechanism which alters a cross-sectional area of a pipe forming the flow path. According to this, the flow path resistance altering device can be simplified and costs can be reduced. For example, a flexible tube is used as a member forming the supply pipe, and a mechanism is provided which changes the cross-sectional surface area of the flow path by pressing and squeezing the tube in the radial direction.

The present invention is also directed to an image forming apparatus comprising the above-described liquid supply device, the image forming apparatus forming an image on a recording medium by means of the liquid ejected from the ejection heads.

A compositional example of an ejection head is a full line type inkjet head having a nozzle row in which a plurality of nozzles for ejecting ink are arranged through a length corresponding to the full width of the recording medium.

In this case, a mode may be adopted in which a plurality of relatively short ejection heads having nozzles rows which do not reach a length corresponding to the full width of the recording medium are combined and joined together, thereby forming a nozzle row that corresponds to the full width of the recording medium.

A full line type inkjet head is usually disposed in a direction that is orthogonal to the relative feed direction (relative conveyance direction) of the recording medium, but modes may also be adopted in which the inkjet head is disposed following an oblique direction that forms a prescribed angle with respect to the direction orthogonal to the conveyance direction.

"Recording medium" indicates a medium on which an image is recorded by means of the action of the ejection head (this medium may also be called an ejection receiving medium, print medium, image forming medium, recording medium, image receiving medium, or the like). This term includes various types of media, irrespective of material and size, such as continuous paper, cut paper, sealed paper, resin sheets, such as OHP sheets, film, cloth, a printed circuit board on which a wiring pattern or the like is formed by means of an ejection head, and an intermediate transfer medium in a transfer image forming apparatus.

The movement device for causing the recording medium and the ejection head to move relatively to each other may include a mode where the recording medium is conveyed with respect to a stationary (fixed) ejection head, or a mode where an ejection head is moved with respect to a stationary recording medium, or a mode where both the ejection head and the recording medium are moved.

Preferably, the image forming apparatus further comprises a flow path resistance control device which functions as a recording density correction device which suppresses variation in recording density between the plurality of ejection heads by controlling the flow path resistance altering device so as to adjust a supply pressure at each of the plurality of ejection heads.

By altering the flow path resistance by means of the flow path resistance altering device, it is possible to adjust the supply pressure to the respective ejection heads, and it is also possible to adjust the amount of liquid ejected by the ejection heads. In other words, it is possible to correct the recording density at each head by controlling the flow path resistance. In this way, by suppressing density variations between heads by controlling the flow path resistance, high-quality image formation can be achieved.

Desirably, a density measuring device which measures the recording density achieved by the respective ejection heads is provided additionally, in such a manner that the density is corrected by adjusting the flow path resistances of the ejection heads on the basis of the measurement results from this device.

According to the present invention, a plurality of branch pipes having different numbers of branches are formed by repeatedly ramifying the downstream side of a supply pipe which sends liquid from a liquid tank to a plurality of ejection heads, and these branch pipes are connected respectively to different ejection heads. By connecting branch pipes having a small number of branches to ejection heads having a relatively high ejection frequency, and by providing a flow path resistance altering device in at least one of the flow paths from the ramifying sections to the ejection heads, it is possible to provide a suitable liquid supply to each of the ejection heads and hence the liquid supply speed can be improved and stable liquid supply can be achieved, and refill response characteristics can also be improved. Furthermore, by improving refilling characteristics in this way, it becomes possible to use a higher ejection frequency and to eject liquid of higher viscosity, than in the prior art.

Furthermore, the present invention may also be applied to an odd number (at least three) of ejection heads, and hence it has a merit in that freedom of layout is increased in comparison with a conventional composition.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
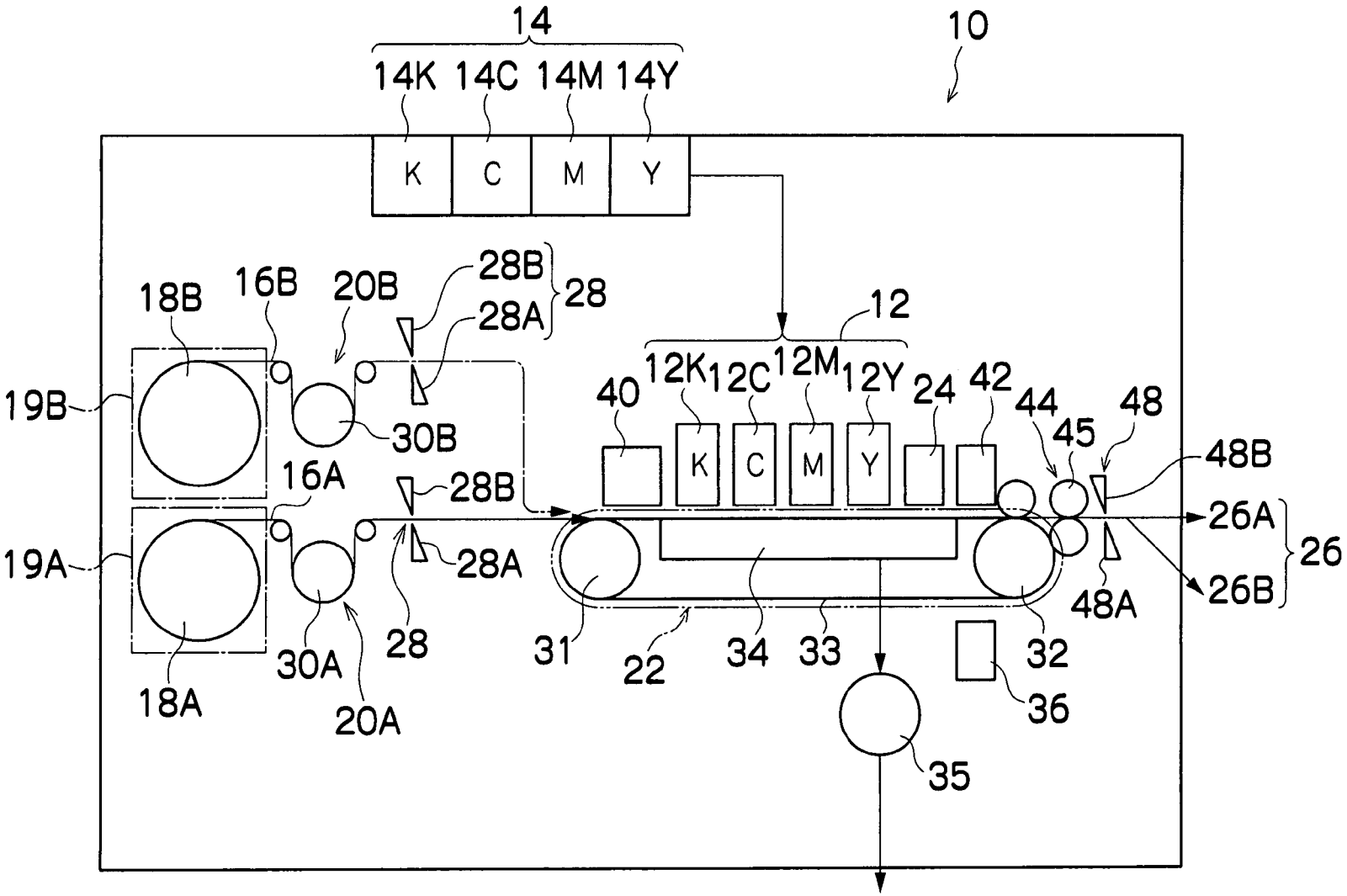
FIG. 1 is a general schematic drawing of an inkjet recording apparatus using a liquid supply device according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads (hereinafter, referred to as head) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; paper supply units 18A and 18B for supplying recording paper 16A and 16B; decurling units 20A and 20B for removing curl in the recording paper 16A and 16B; a suction belt conveyance unit 22 disposed facing the nozzle face (ink-droplet ejection face) of the print unit 12, for conveying the recording paper 16A and 16B while keeping the recording paper 16A and 16B flat; a print determination unit 24 for reading the printed result produced by the printing unit 12; and a paper output unit 26 for outputting image-printed recording paper (printed matter) to the exterior.

The ink storing and loading unit 14 has tanks for storing the inks of K, C, M and Y to be supplied to the print heads 12K, 12C, 12M, and 12Y, and the tanks are connected to the print heads 12K, 12C, 12M, and 12Y through channels (not shown), respectively. The ink storing and loading unit 14 has a warning device (e.g., a display device, an alarm sound generator) for warning when the remaining amount of any ink is low, and has a mechanism for preventing loading errors among the colors.

In FIG. 1, the magazines 19A and 19B for rolled paper (continuous paper) are shown as examples of the twin paper supply units 18A and 18B supplying the recording paper 16A and 16B having different paper widths; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16A and 16B delivered from the paper supply units 18A and 18B, retain curl due to having been loaded in the magazines 19A and 19B. In order to remove the curl, heat is applied to the recording paper 16A and 16B in the decurling units 20A and 20B by heating drums 30A and 30B in the direction opposite from the curl direction in the magazines. The heating temperature at this time is preferably controlled so that the recording paper 16A and 16B have a curl in which the surface on which the print is to be made is slightly round outward.

In the case of the configuration in which roll paper is used, cutters (first cutters) 28 are provided as shown in FIG. 1, and the continuous paper is cut into a desired size by the cutters 28. Each of the cutters 28 has a stationary blade 28A, whose length is not less than the width of the conveyor pathway of the recording paper 16A or 16B, and a round blade 28B, which moves along the stationary blade 28A. The stationary blade 28A is disposed on the reverse side of the printed surface of the recording paper 16A or 16B, and the round blade 28B is disposed on the printed surface side across the conveyor pathway. When cut paper is used, the cutter 28 is not required.

The decurled and cut recording paper 16A or 16B is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16A and 16B, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor 188 (not shown in FIG. 1, but shown in FIG. 9) being transmitted to at least one of the rollers 31 and 32, which the belt 33 is set around, and the recording paper 16A or 16B held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 forms a so-called full-line head in which a line head having a length that corresponds to the maximum paper width is disposed in the main scanning direction perpendicular to the delivering direction of the recording paper 16A or 16B (hereinafter referred to as the paper conveyance direction), which is substantially perpendicular to a width direction of the recording paper 16A or 16B.

The print heads 12K, 12C, 12M, and 12Y are arranged in order of black (K), cyan (C), magenta (M), and yellow (Y) from the upstream side along the paper conveyance direction. Each of the print heads 12K, 12C, 12M, and 12Y is arranged and fixed so that its lengthwise direction is substantially perpendicular to the conveyance direction of the recording paper 16A and 16B.

A color print can be formed on the recording paper 16 by ejecting the inks from the print heads 12K, 12C, 12M, and 12Y, respectively, onto the recording paper 16A or 16B while conveying the recording paper 16A or 16B.

The print unit 12, in which the full-line heads covering the entire width of the paper are thus provided for the respective ink colors, can record an image over the entire surface of the recording paper 16A or 16B by performing the action of moving the recording paper 16A or 16B and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light ink, and/or dark ink, and/or special color ink can be added as required. For example, a configuration is possible in which print heads for ejecting light-colored inks such as light cyan and light magenta are added. Additionally, the arranged order of print heads 12K, 12C, 12M, and 12Y is not also limited to those.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

The post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in FIG. 1, the paper output unit 26A for the target prints is provided with a sorter for collecting prints according to print orders.

The Configuration of the Print Head

Next, the structure of the print heads is described. The print heads 12K, 12C, 12M and 12Y have the same structure, and a reference numeral 50 is hereinafter designated to any of the print heads 12K, 12C, 12M and 12Y.

Figure 2:
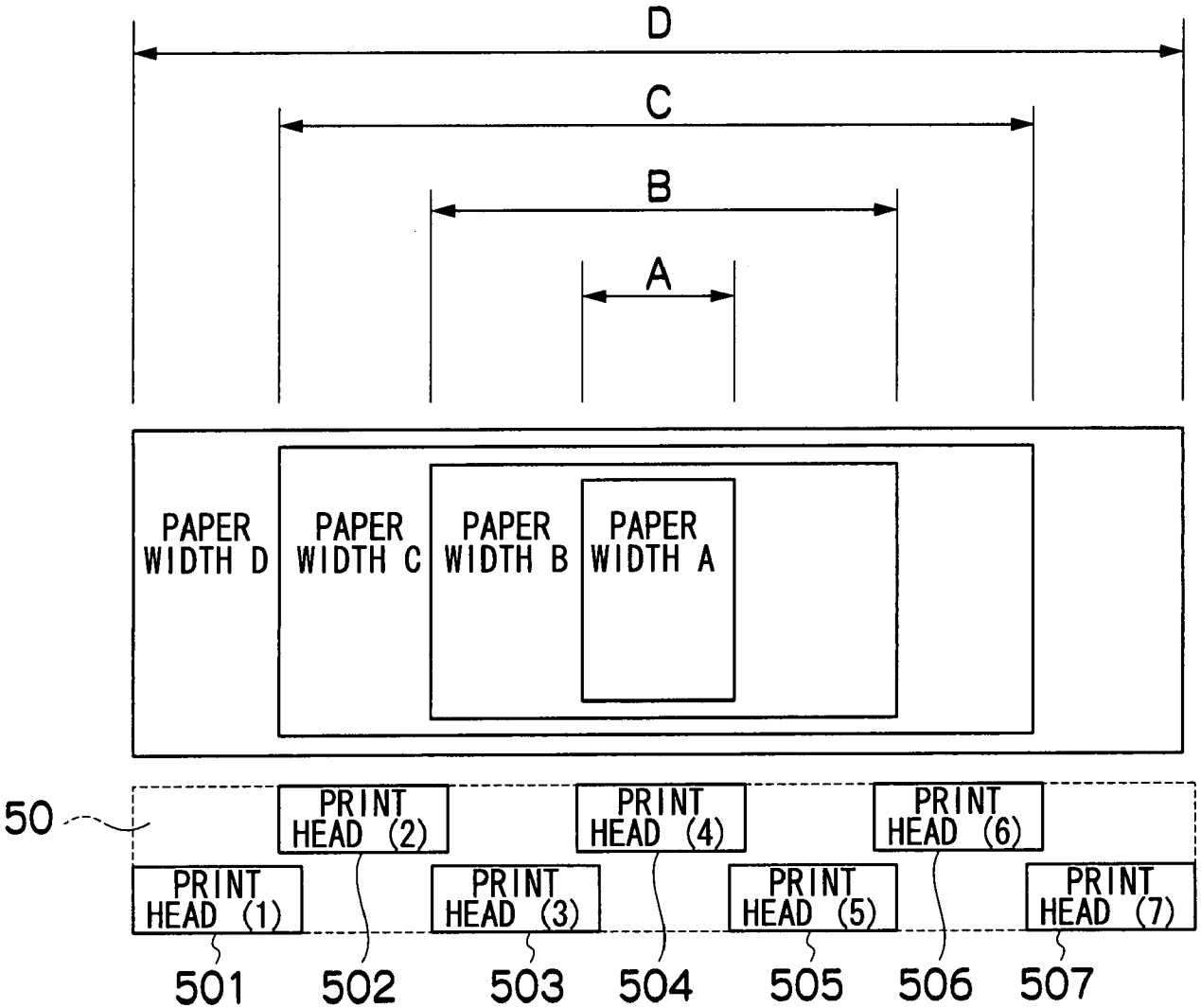
FIG. 2 is a perspective plan view showing the relationship between a print head structure and a recording medium.

FIG. 2 is a schematic plan view showing the relationship between the structure of the print head 50 and the recording medium. In this drawing, four types of recording medium having a paper width A, paper width B, paper width C, paper width D (A<B<C<D) are depicted, and the print head 50 is a line head having a length corresponding to the largest paper width D. The respective recording media having different widths are each aligned with the center in the lateral direction, and are conveyed in a direction orthogonal to the lengthwise direction of the head 50.

The head 50 has a structure in which a long dimension is achieved by joining together a plurality of head blocks 501 to 507 in a staggered matrix arrangement. Thereby, a row of nozzles having a length corresponding to the full width of the largest paper width D is achieved. For the sake of convenience, the head blocks are called the first head block 501, second head block 502, and so on, from the left-hand side in FIG. 2. The right-hand-most block is called the seventh head block 507. In FIG. 2, for the sake of simplification, "head blocks 501 to 507" are indicated as "heads (1) to (7)".

The fourth head block 504 disposed in the central portion of the line head has a nozzle row of a length corresponding to the shortest width A, and when printing onto a recording medium of the paper width A, ink is ejected from this head block 504 only. Furthermore, the fourth head block 504, in combination with the adjacent head blocks 503 and 505, achieves a nozzle row of a length corresponding to the paper width B, and therefore, when printing onto a recording medium of the paper width B, only the third to fifth head blocks 503 to 505 are used. Similarly, when printing onto a recording medium of the paper width C, only the second to sixth head blocks 502 to 506 are used, and when printing onto a recording medium of the paper width D, ink is ejected from all of the head blocks 501 to 507.

In the inkjet recording apparatus 10 of the present example, it is supposed that recording media having the shortest width A are printed most frequently, and the use frequency of the recording media of respective widths are taken to be: paper width A>paper width B>paper width C>paper width D.

In more concrete terms, the inkjet recording apparatus 10 is used in a minilab device which performs high-quality printing of photographic quality, for example. L size (89 mm×127 mm) print output is the most frequent, while larger print sizes, 203 mm×254 mm, and 254 mm×305 mm, are output occasionally.

In the example shown in FIG. 2, one line head 50 is divided into seven head blocks, but in implementing the present invention, the number of divisions in the head, and the length and arrangement configuration of each head block is not limited to that of the present example, and various different designs may be adopted, by taking account of the width dimensions of the recording media.

Figure 3A:
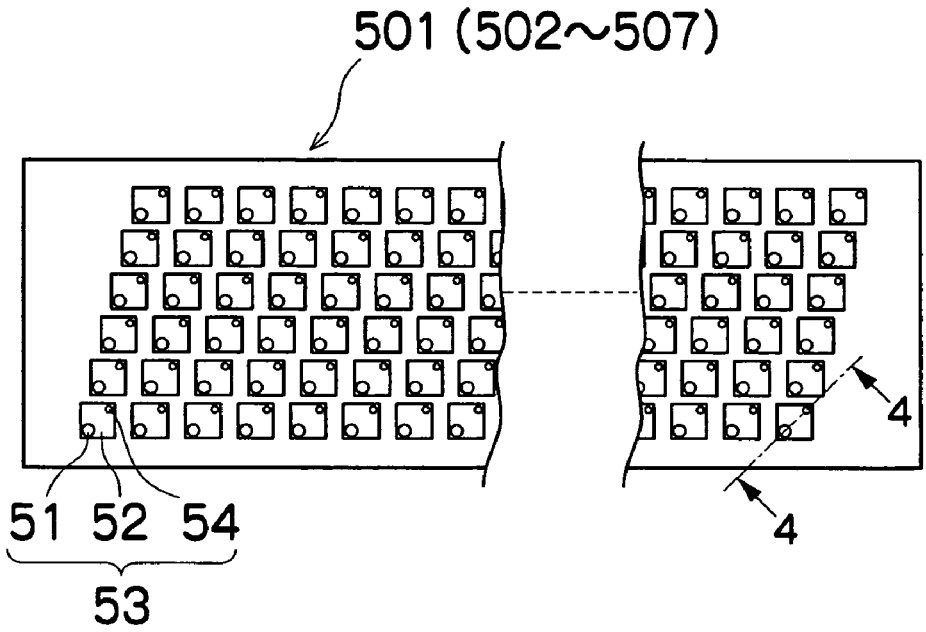
FIGS. 3A and 3B are perspective plan views showing an example of the structure of a head block forming a line head.
Figure 3B:
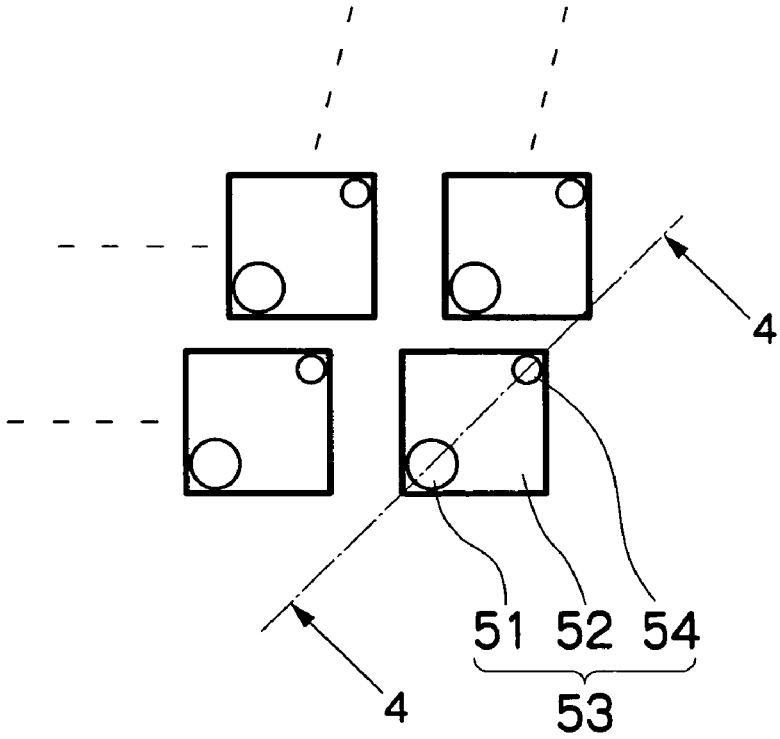

FIG. 3A is a plan view perspective diagram showing an example of the structure of a head block 501, and FIG. 3B is an enlarged diagram of a portion of same. Since the other head blocks 502 to 507 have substantially the same structure, the head block labeled 501 is described here as a representative example.

As shown in FIGS. 3A and 3B, the head block 501 has a structure in which a plurality of ink chamber units (liquid droplet ejection elements) 53, each including a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is made small.

The planar shape of the pressure chamber 52 provided for each nozzle 51 is substantially a square, and the nozzle 51 and an inlet of supplied ink (supply port) 54 are disposed in both corners on a diagonal line of the square. The shape of the pressure chamber 52 is not limited to the present embodiment, and the planar shape of this may be a quadrangle (a diamond, an oblong, or the like), a pentagon, a hexagon, and the other polygon, or a circle, and an ellipse.

Figure 4:
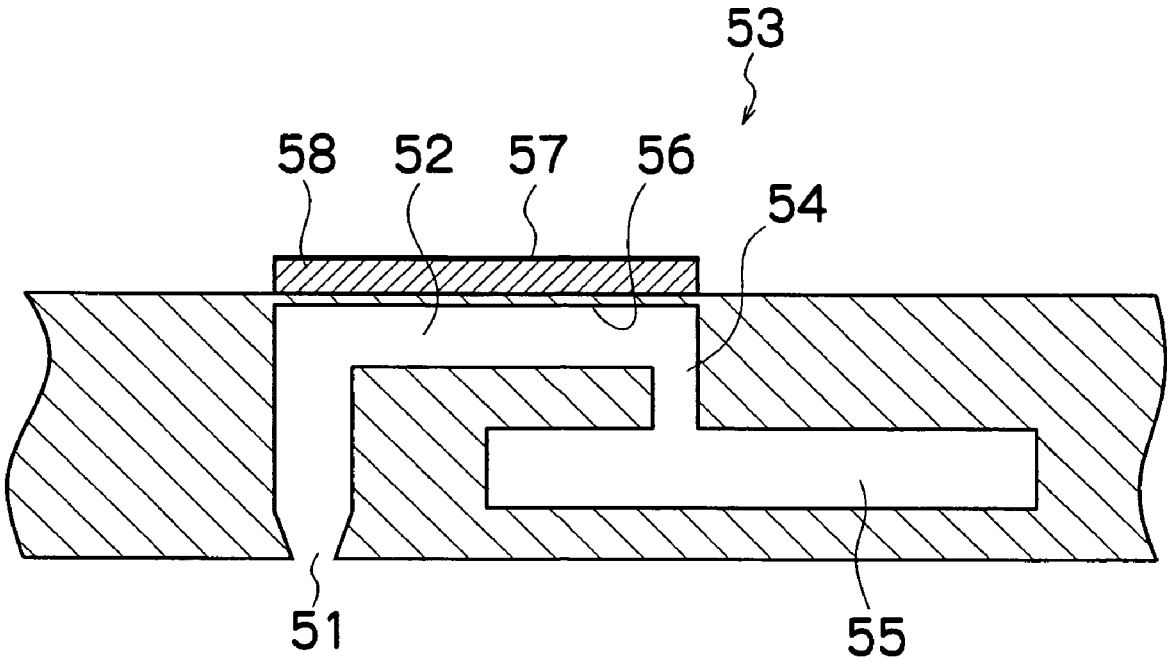
FIG. 4 is a cross-sectional view along line 4-4 in FIGS. 3A and 3B.

FIG. 4 is a cross-sectional view taken along the line 4-4 in FIGS. 3A and 3B, showing the inner structure of an ink chamber unit corresponding to a nozzle 51.

As shown in FIG. 4, each pressure chamber 52 is connected to a common channel 55 through the supply port 54. The common channel 55 is connected to an ink tank 60 (not shown in FIG. 4, but shown in FIG. 1 as anyone of the tanks 14K, 14C, 14M, and 14Y), which is a base tank that supplies ink, and the ink supplied from the ink tank 60 is delivered through the common flow channel 55 to the pressure chamber 52.

An actuator 58 provided with an individual electrode 57 is bonded to a pressure plate (vibration plate) 56, which forms the part of the pressure chamber 52 (the upper face in FIG. 4). When a drive voltage is applied to the individual electrode 57, the actuator 58 is deformed, the volume of the pressure chamber 52 is thereby changed, and the pressure in the pressure chamber 52 is thereby changed, so that the ink inside the pressure chamber 52 is thus discharged through the nozzle 51. The actuator 58 is preferably a piezoelectric element. When ink is discharged, new ink is supplied to the pressure chamber 52 from the common flow channel 55 through the supply port 54.

Figure 5:
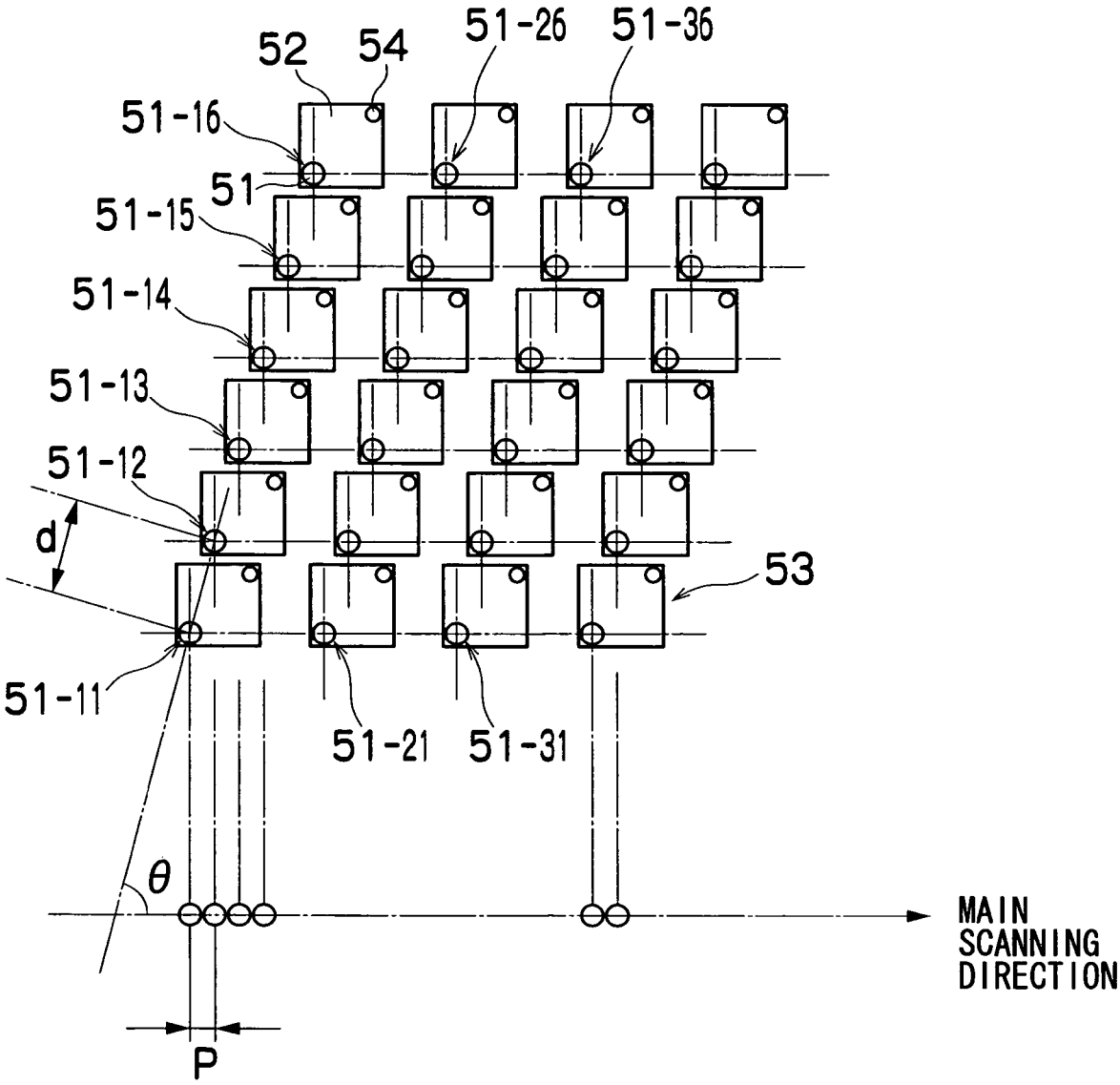
FIG. 5 is an enlarged view showing the arrangement of nozzles in a print head.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the image recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording papers 16A and 16B by sequentially driving the nozzles 51-11, 51-12, . . . , 51-16 in accordance with the conveyance velocity of the recording papers 16A and 16B.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

The "main scanning direction" is described as the direction of one line recorded by the above-described main scanning, the "sub-scanning direction" is described as the direction performing the above-described sub-scanning. More specifically, in the present embodiment, the delivering direction of the recording paper 16A and 16B is the sub-scanning direction, and the direction perpendicular to the sub-scanning direction is the main scanning direction.

In implementing the present invention, the arrangement of the nozzles is not limited to that of the example illustrated. Moreover, a method is employed in the present embodiment where an ink droplet is ejected by means of the deformation of the actuator 59, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure of these bubbles.

The Configuration of the Ink Supply System

Figure 6:
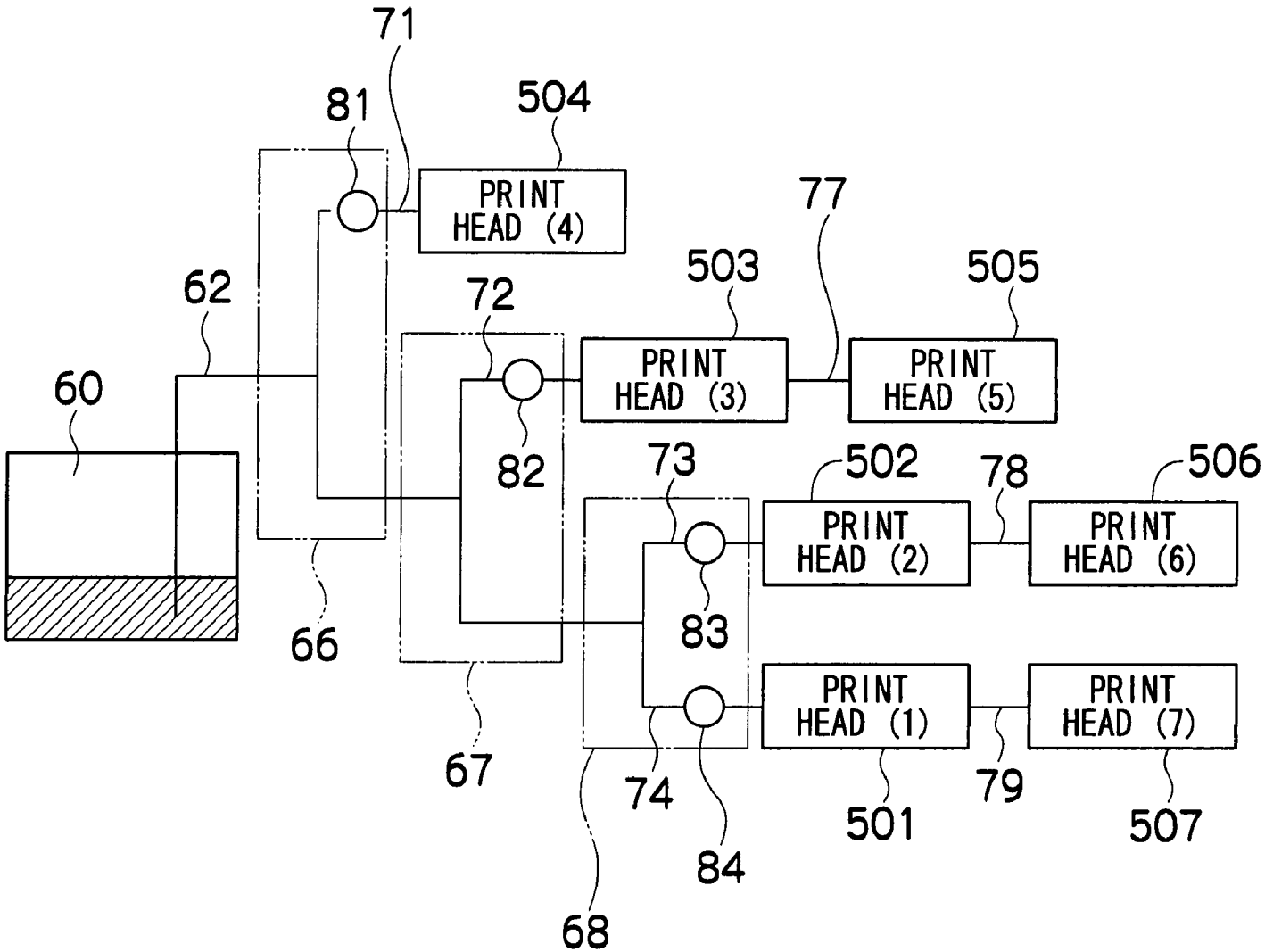
FIG. 6 is a schematic piping diagram showing the composition of an ink supply system in the inkjet recording apparatus.

FIG. 6 is a schematic drawing showing the configuration of the ink supply system in the inkjet recording apparatus 10. FIG. 6 shows an example of a piping arrangement in a case where the use frequency relationship is "paper width A>paper width B>paper width C>paper width D" as described in FIG. 2. The paper use frequency corresponds to the ejection frequencies of the respective head blocks 501 to 507.

In FIG. 6, the ink tank 60 is a base tank for supplying ink to the head 50, and is disposed in the ink storing and loading unit 14 illustrated in FIG. 1. The ink tank 60 may adopt a system for replenishing ink by means of a replenishing port (not illustrated), or a cartridge system in which cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type. The ink tank 60 in FIG. 6 is equivalent to the ink tanks 14K, 14C, 14M and 14Y shown in FIG. 1 and described above.

As shown in FIG. 6, the upstream end of a supply pipe (corresponding to a supply passage) 62 for supplying ink from the ink tank 60 to the head 50 is connected to the ink tank 60, and the downstream end thereof is branched into four branch pipes (corresponding to branch passages) 71 to 74 by means of a first ramifying pipe 66, a second ramifying pipe 67, and a third ramifying pipe 68 (these ramifying pipes each corresponding to a ramifying section).

One of the branch pipes 71 which branches from the first ramifying pipe 66 is connected to the fourth head block 504, and the other branch pipe is branched further by the second ramifying pipe 67. One of the branch pipes 72 from the second ramifying pipe 67 is connected to the third head block 503, and the other branch pipe is branched further by the third ramifying pipe 68.

One of the branch pipes 73 which branches from the third ramifying pipe 68 is connected to the second head block 502, and the other branch pipe 74 is connected to the first head block 501.

Moreover, the third head block 503 and the fifth head block 505 are connected by means of a connecting pipe 77, thereby forming a structure in which ink is supplied to the fifth head block 505 by passing along a flow path inside the third head block 503 and the connecting pipe 77.

Furthermore, the second head block 502 and the sixth head block 506 are connected by means of a connecting pipe 78, ink being supplied to the sixth head block 506 by passing along a flow path inside the second head block 502 and the connecting pipe 78. Furthermore, the first head block 501 and the seventh head block 507 are connected by means of a connecting pipe 79, ink being supplied to the seventh head block 507 by passing along a flow path inside the first head block 501 and the connecting pipe 79.

In this way, the branch pipe 71 having the smallest number of branches (namely, one branch) is connected to the fourth head block 504, which has the highest use frequency (namely, the highest ejection frequency). The branch pipe 72, which comprises two branches, is connected to the third head block that corresponds to the paper width B having the next highest use frequency. Thereafter, a piping structure is adopted in which branch pipes having a smaller number of branches are connected to head blocks that correspond to more frequently used paper widths, in such a manner that the branch pipes 73 and 74 which comprise three branches are connected to the head blocks 502 and 501 that correspond to paper widths C and D having a low use frequency.

Circles 81 to 84 in FIG. 6 represent flow path load units which function as devices for altering the resistance of the flow path. In other words, in the branch pipes 71 to 74, flow path load units 81 to 84 are disposed respectively upstream of the head blocks 504, 503, 502 and 501, and the flow path load units 81 to 84 are controlled according to requirements.

Figure 7:
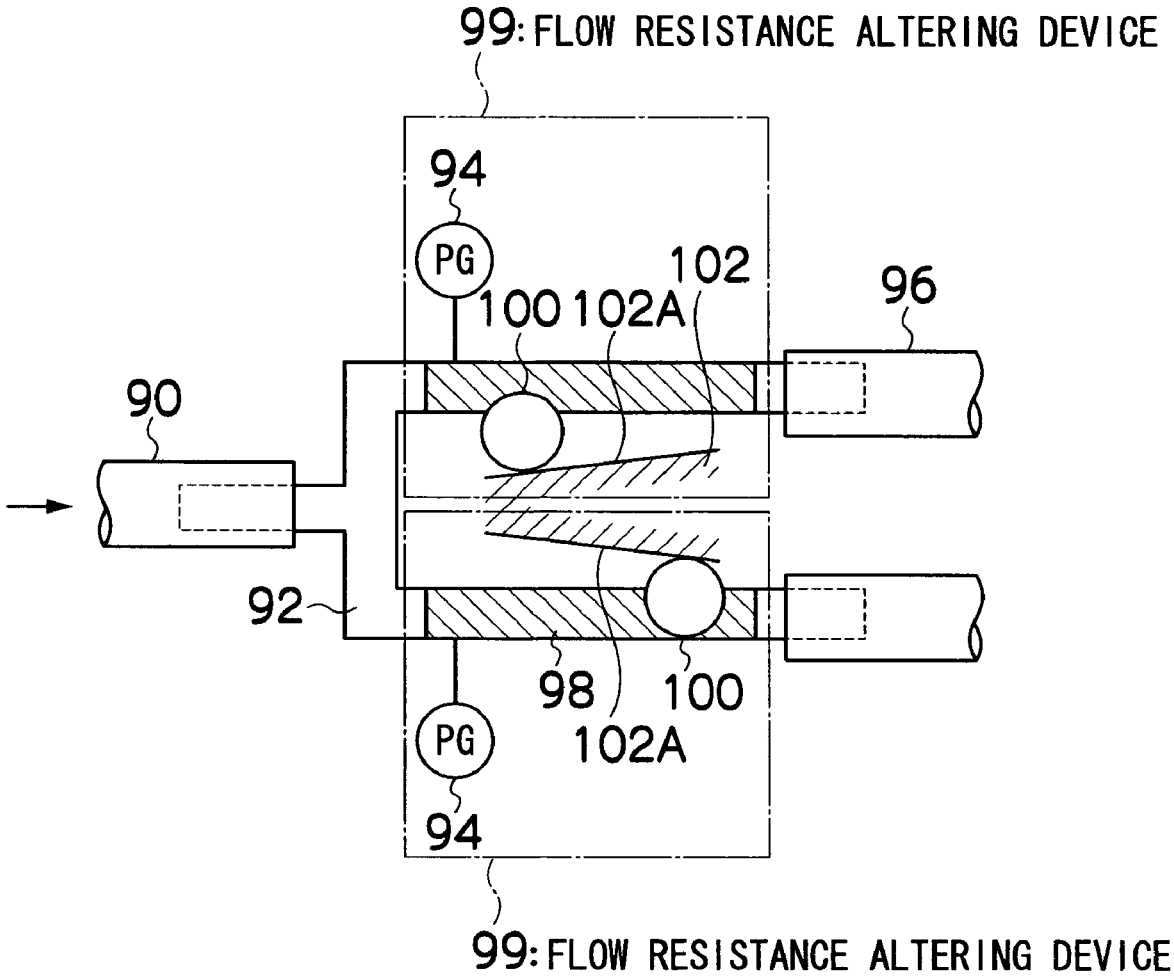
FIG. 7 is a drawing showing an example of the structure of a ramifying pipe including a flow path load unit.

FIG. 7 is a schematic drawing showing an example of the structure of a ramifying pipe including a flow path load unit. In FIG. 7, reference numeral 90 denotes an upstream side tube, numeral 92 denotes a ramifying pipe, numeral 94 denotes a pressure gauge and numeral 96 denotes a downstream side tube.

In the ramifying pipe 92 illustrated, at least one portion of the branch pipes after ramifying (the obliquely shaded section indicted by numeral 98 in the drawing) is constituted by an elastic member (for example, a flexible tube). A flow path resistance altering device 99 includes a roller 100, which presses and squeezes the elastic pipe section 98, and a motor (not illustrated) for driving the roller 100. The roller 100 is biased toward an inclined face 102A of a tapered member 102 by means of a biasing device based on a spring, or the like (not illustrated), and the roller 100 is caused to rotate and travel while contacting the inclined face 102A, by the driving force of the motor (not illustrated). The amount by which the elastic pipe section 98 is pressed and squeezed can be altered continuously by controlling the position of the roller 100. The cross-sectional area of the flow path is changed by the deformation of the elastic pipe section 98, and the flow path resistance changes accordingly. Naturally, it is also possible to shut off the flow path by pressing and squeezing the elastic pipe section 98 completely by means of the roller 100.

By applying the structural example shown in FIG. 7, to FIG. 6, it is possible to control the flow path resistance of the system supplying ink to the head blocks 501 to 507.

Figure 8:
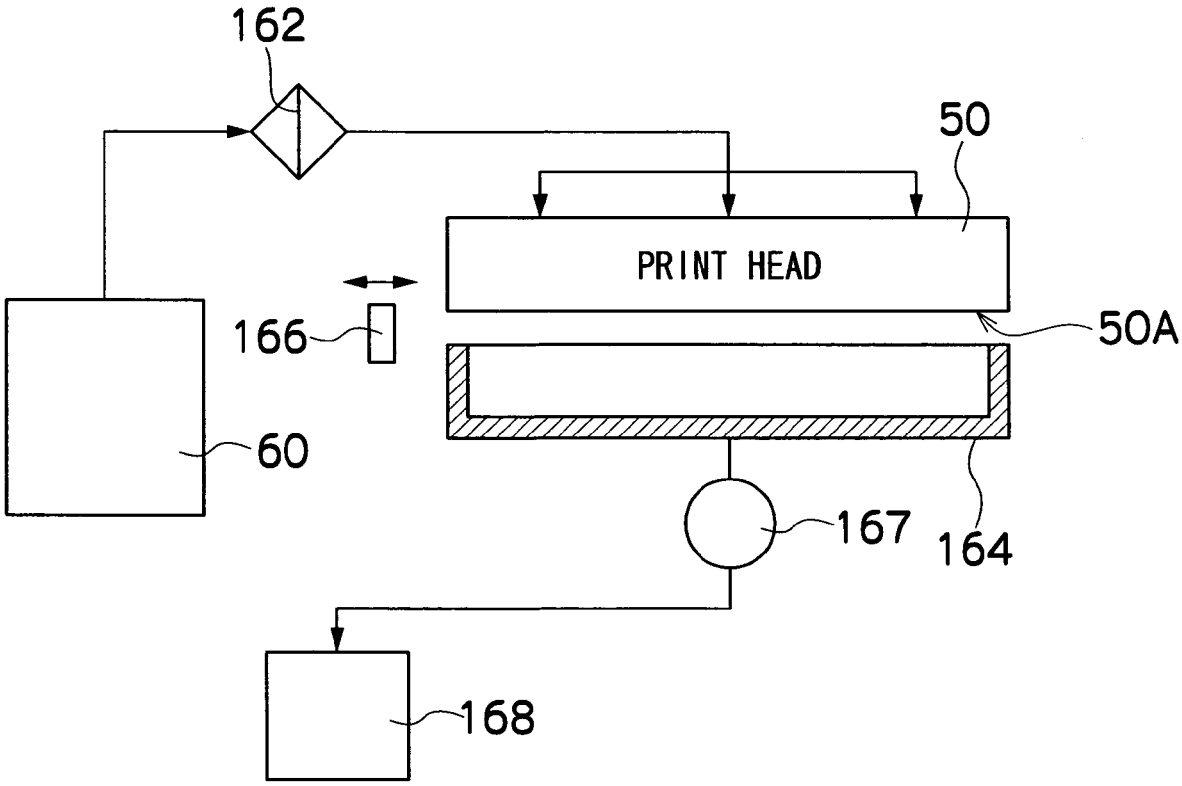
FIG. 8 is a general schematic drawing of an ink supply system and the maintenance system of a print head.

FIG. 8 is a general schematic drawing including an ink supply system and a maintenance system of the head 50. As shown in FIG. 8, a filter 162 is provided between the ink tank 60 and the head 50, in order to remove foreign matter and air bubbles. Desirably, the filter mesh size is the same as the nozzle diameter, or smaller than the nozzle diameter (generally, about 20 μm). Although not shown in FIG. 8, desirably, a composition is adopted in which a subsidiary tank is provided in the vicinity of the head 50, or in an integrated manner with the head 50. The subsidiary tank has the function of improving damping effects and refilling, in order to prevent variations in the internal pressure inside the head.

Furthermore, the inkjet recording apparatus 10 is also provided with a cap 164 as a device to prevent the nozzles 51 from drying out or to prevent an increase in the ink viscosity in the vicinity of the nozzles 51, and a cleaning blade 166 as a device to clean the nozzle face 50A. A maintenance unit including the cap 164 and the cleaning blade 166 can be moved in a relative fashion with respect to the head 50 by a movement mechanism (not shown), and is moved from a predetermined holding position to a maintenance position below the head 50 as required.

The cap 164 is displaced upwards and downwards relatively with respect to the head 50 by an elevator mechanism (not illustrated). When the power is switched OFF or when in a print standby state, the cap 164 is raised to a predetermined elevated position so as to come into close contact with the head 50, and the nozzle face 50A is thereby covered with the cap 164.

The cleaning blade 166 is composed of rubber or another elastic member, and can slide on the ink ejection surface (surface of the nozzle plate) of the head 50 by means of a blade movement mechanism (not shown). If there are ink droplets or foreign matter adhering to the nozzle plate, then the nozzle plate surface is wiped by causing the cleaning blade 166 to slide over the nozzle plate, thereby cleaning the nozzle plate surface.

During printing or during standby, if the use frequency of a particular nozzle has declined and the ink viscosity in the vicinity of the nozzle has increased, then a preliminary ejection is performed onto the cap 164, in order to remove the degraded ink.

Also, when bubbles have become intermixed in the ink inside the head 50 (inside the pressure chamber), the cap 164 is placed on the head 50, ink (ink in which bubbles have become intermixed) inside the pressure chamber is removed by suction with a suction pump 167, and the ink removed by suction is sent to a collection tank 168. This suction operation is also carried out in order to remove degraded ink having increased viscosity (hardened ink), when ink is loaded into the head for the first time, and when the head 50 starts to be used after having been out of use for a long period of time.

When a state in which ink is not ejected from the head 50 continues for a certain amount of time or longer, the ink solvent in the vicinity of the nozzles 51 evaporates and ink viscosity increases. In such a state, ink can no longer be ejected from the nozzle 51 even if the actuator 58 for driving ejection is operated. Therefore, before reaching such a state, the actuator 58 is operated toward an ink receptacle (in a viscosity range that allows ejection by the operation of the actuator 58), and a preliminary ejection is performed which causes the ink in the vicinity of the nozzle whose viscosity has increased to be ejected. Furthermore, after cleaning away soiling on the surface of the nozzle plate by means of a wiper, such as a cleaning blade 66, provided as a cleaning device on the nozzle surface 50A, a preliminary ejection is also carried out in order to prevent infiltration of foreign matter inside the nozzles 51 due to the rubbing action of the wiper. The preliminary ejection is also referred to as "dummy ejection", "purge", "liquid ejection", and so on.

When bubbles have become intermixed in the nozzle 51 or the pressure chamber 52, or when the ink viscosity inside the nozzle 51 has increased over a certain level, ink can no longer be ejected by means of a preliminary ejection, and hence a suctioning action is carried out as follows.

More specifically, when bubbles have become intermixed in the ink inside the nozzle 51 and the pressure chamber 52, or when the ink viscosity inside the nozzle 52 has increased to a certain level or more, ink can no longer be ejected from the nozzles 51 even if the actuator 58 is operated. In cases of this kind, a suctioning device for suctioning ink inside the pressure chamber 52 by means of a pump, or the like, abuts against the nozzle surface of the head 50, and an operation for suctioning the ink containing an air bubble, or the ink of increased viscosity, is carried out.

However, this suction action is performed with respect to all the ink in the pressure chamber 52, and therefore the amount of ink consumption is considerable. Consequently, it is desirable that a preliminary ejection is carried out, whenever possible, while the increase in viscosity is still small.

Explanation of the Control System

Figure 9:
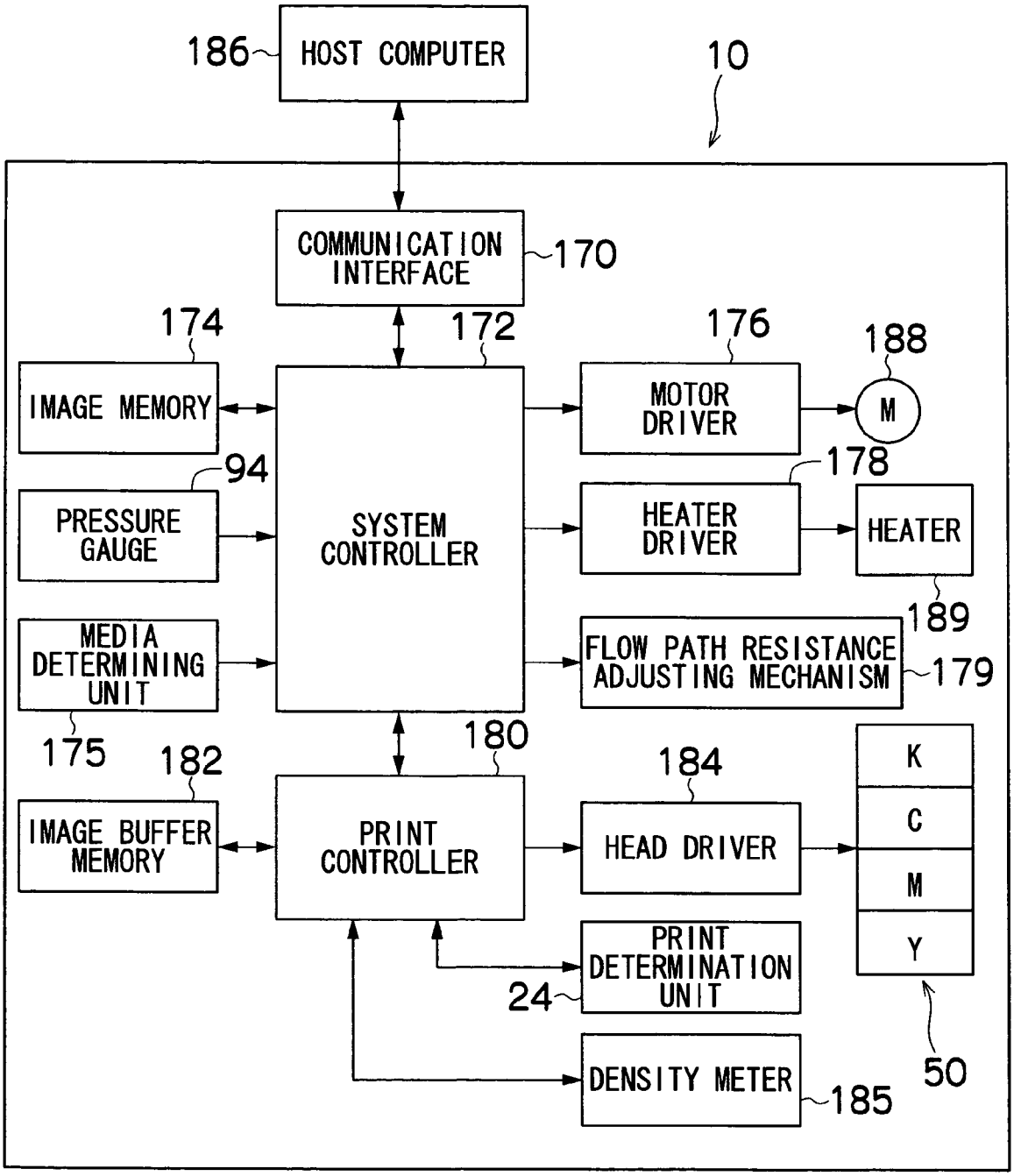
FIG. 9 is a principal block diagram showing the system composition of the inkjet recording apparatus.

Next, the control system of the inkjet recording apparatus 10 is described. FIG. 9 is a block diagram of the principal components showing the system configuration of the inkjet recording apparatus 10. The inkjet recording apparatus 10 has a communication interface 170, a system controller 172, an image memory 174, a motor driver 176, a heater driver 178, a print controller 180, an image buffer memory 182, a head driver 184, a density meter 185, and other components.

The communication interface 170 is an interface unit for receiving image data sent from a host computer 186. A serial interface such as USB, IEEE1394, Ethernet, wireless network, or a parallel interface such as a Centronics interface may be used as the communication interface 170. A buffer memory (not shown) may be mounted in this portion in order to increase the communication speed. The image data sent from the host computer 186 is received by the inkjet recording apparatus 10 through the communication interface 170, and is temporarily stored in the image memory 174. The image memory 174 is a storage device for temporarily storing images inputted through the communication interface 170, and data is written and read to and from the image memory 174 through the system controller 172. The image memory 174 is not limited to memory composed of a semiconductor element, and a hard disk drive or another magnetic medium may be used.

The system controller 172 is a control unit for controlling the various units, such as the communications interface 170, the image memory 174, the motor driver 176, the heater driver 178, the flow path resistance adjusting mechanism 179, and the like. The system controller 172 is constituted by a central processing unit (CPU) and related peripheral circuits, and the like. The system controller 172 controls communications with the host computer. 186 and reading and writing to and from the image memory 174, and it also generates control signals for controlling the motor 188 of the conveyance system and a heater 189, and control signals for controlling the flow path resistance adjusting mechanism 179.

The flow path resistance adjusting mechanism 179 corresponds to the flow path load units 81 to 84 shown in FIG. 6, and is a block including the structure shown in FIG. 7 and a drive device, such as a motor.

The media determining unit 175 shown in FIG. 9 is a device for determining the type and size (such as the width) of recording media. This unit uses, for example, a device for reading in information such as bar codes attached to the magazines 19A and 19B, or sensors disposed at a suitable position in the paper conveyance path (a sensor for measuring the width of the paper, a sensor for measuring the thickness of the paper, a sensor for measuring the reflectivity of the paper, and so on). A suitable combination of these elements may also be used. Furthermore, it is also possible to adopt a composition in which information relating to the paper type, size, or the like, is specified by means of an input via a prescribed user interface, instead of or in conjunction with such automatic determining devices.

Information obtained by the media determining unit 175 is reported to the system controller 172 and/or the print controller 180, and is used to control ink ejection and to control the flow path resistance adjusting mechanism 179, and so on.

The motor driver 176 is a driver (drive circuit) which drives the motor 188 in accordance with instructions from the system controller 172. The heater driver 178 is a driver for driving the heater 189 of the post-drying unit 42, and other units, in accordance with instructions from the system controller 172.

The print controller 180 is a control unit having a signal processing function for performing various treatment processes, corrections, and the like, in accordance with the control implemented by the system controller 172, in order to generate a signal for controlling printing, from the image data in the image memory 174, and it supplies the print control signal (dot data) thus generated to the head driver 184. Prescribed signal processing is carried out in the print controller 180, and the ejection amount and the ejection timing of the ink from the head 50 are controlled via the head driver 184, on the basis of the image data. By this means, prescribed dot size and dot positions can be achieved.

The print controller 180 is provided with the image buffer memory 182; and image data, parameters, and other data are temporarily stored in the image buffer memory 182 when image data is processed in the print controller 180. FIG. 9 shows an aspect in which the image buffer memory 182 is attached to the print controller 180, however, the image memory 174 may also serve as the image buffer memory 182. Also possible is an aspect in which the print controller 180 and the system controller 172 are integrated to form a single processor.

The head driver 184 drives the actuators 58 which drive ejection in the respective color heads 50, on the basis of the dot data supplied from the print controller 180. A feedback control system for keeping the drive conditions for the print heads constant may be included in the head driver 184.

The image data to be printed is externally inputted through the communications interface 170, and is stored in the image memory 174. At this stage, RGB image data is stored in the image memory 174, for example. The image data stored in the image memory 174 is sent to the print controller 180 through the system controller 172, and is converted to the dot data for each ink color by a known dithering algorithm, random dithering algorithm or another technique in the print controller 180.

The print head 50 is driven on the basis of the dot data thus generated by the print controller 180, so that ink is ejected from the head 50. By controlling ink ejection from the head 50 in synchronization with the conveyance speed of the recording paper, an image is formed on the recording paper.

As shown in FIG. 1, the print determination unit 24 is a block including a line sensor, which reads in the image printed onto the recording medium, performs various signal processing operations, and determines the print situation (presence/absence of ejection, variation in droplet ejection, etc.). The print determination unit 24 supplies the determination results to the print controller 180. The read start timing of the line sensor is determined from the distance between the sensor and the nozzle and the conveyance speed of the recording medium.

The print controller 180 and/or the system controller 172 judges the ejection state of the nozzles 51 on the basis of the determination information obtained from the print determination unit 24, and if a defective nozzle is detected, then control is implemented in order to perform a prescribed restoring operation, to correct ejection, or the like.

Density meter 185 is a device for measuring the reflective density of the image (recording result) formed on the recording medium by the ink ejected from the head 50. Any variations in density between the head blocks (501 to 507) forming the head 50 can be ascertained by means of this density meter 185. The print determination unit 24 may also be used as a density determining device. The "reflective density" referred to here is defined by a commonly used tricolor density system, and Status A is used for the spectral sensitivity. This definition is as stated in "ISO 5/3-1984: Photography-Density Measurements-Part3: Spectral conditions".

If a variation in density exceeding a prescribed range of tolerance is detected between the head blocks (501 to 507) in one head 50, then the rollers 100 of the flow path load units 81 to 84 are moved, thereby changing the flow path resistance and hence correcting the density in such a manner that a substantially uniform density is achieved between the head blocks.

According to the inkjet recording apparatus 10 having the composition described above, ink is supplied selectively only to the head block or blocks required in order to print onto the recording medium of the paper width in use, in accordance with the paper width determined by the media determining unit 175. The ink supply flow paths to head blocks that are not in use are closed by pressurizing the elastic pipe sections 98 by means of the rollers 100 in such a manner that ink is not supplied to those blocks.

For example, when printing onto a recording medium of width A, the rollers 100 of the flow path load units 82 to 84 in the second ramifying pipe 67 and the third ramifying pipe 68 in FIG. 6 are driven, thereby closing the flow paths, and the flow path of the flow path load unit 81 in the first ramifying pipe 66 is opened. Hence, ink is supplied to the fourth head block 504 only.

Furthermore, when printing onto a recording medium of width B, the rollers 100 of the flow path load units 83 and 84 in the third ramifying pipe 68 in FIG. 6 are driven, thereby closing the flow path, and the flow paths of the flow path load unit 81 in the first ramifying pipe 66 and the flow path load unit 82 in the second ramifying pipe 67 are opened. Accordingly, ink is supplied to the fourth head block 504, the third head block 503 and the fifth head block 505 only. In this case, the positions of the rollers 100 in the flow path load units 81 and 82 are adjusted in such a manner that the flow path resistances to the respective head blocks 503 to 505 are substantially the same.

As described above, by closing the ink supply flow paths to head blocks which are not to eject ink, maintenance becomes unnecessary for head blocks which are not in use, and hence wasteful consumption of ink can be suppressed. Furthermore, since no ink leakage occurs when there is a paper jam or when the power supply is suddenly shut off, then this is beneficial in terms of safety also.

On the other hand, in the case of a head block that is in use, the value of the pressure gauge 94 is monitored and the positions of the roller 100 is adjusted by driving the motor. When a plurality of head blocks are being used simultaneously, for instance, when using a recording medium of width B to D, the rollers 100 of the respective flow paths are adjusted in such a manner that the flow path resistances match the largest flow resistance value in the plurality of flow paths (the largest value indicated by the pressure gauge 94).

In this way, the flow paths are automatically adjusted to a flow path resistance that suits the number of head blocks used, in such a manner that the flow path resistance to each of the head blocks is substantially the same. Thereby, it is possible to achieve a uniform supply of ink and hence refill response characteristics are improved. By improving refill response characteristics, it is possible to set a high ejection frequency, and hence printing productivity can be improved. Furthermore, by improving refilling performance, it becomes possible to eject liquid of high viscosity.

MODIFICATION EXAMPLE 1

Figure 10:
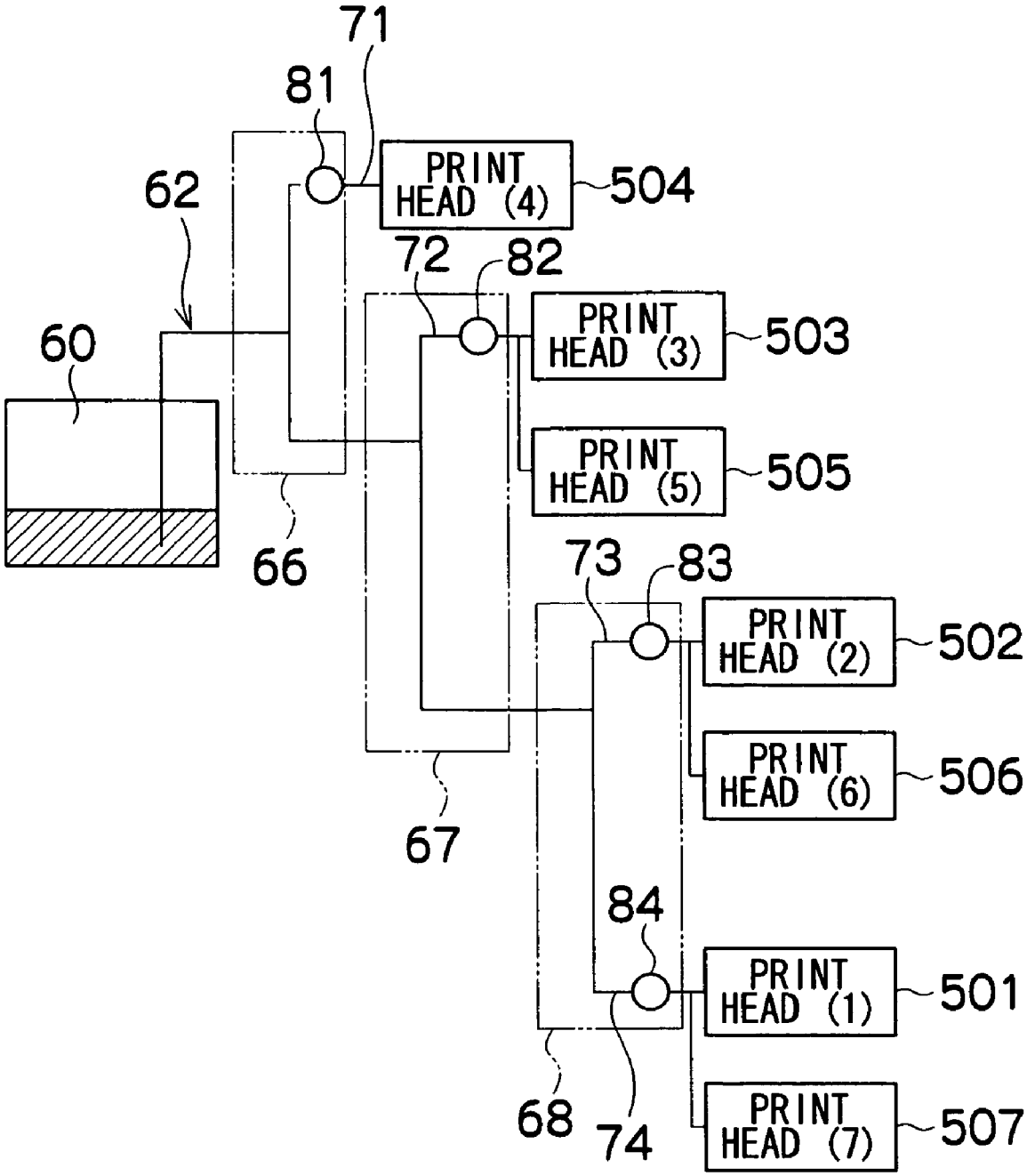
FIG. 10 is a schematic piping diagram showing a further composition of the ink supply system.

In FIG. 6, the third head block 503 and the fifth head block 505 are connected in series by means of a connecting pipe 77, and the second head block 502 and sixth head block 506, and the first head block 501 and seventh head block 507 are respectively connected by connecting pipes 78 and 79. However, as shown in FIG. 10, it is also possible to adopt a mode in which the connecting pipes 77, 78 and 79 are omitted, and the fifth head block 505, the sixth head block 506 and the seventh head block 507 are respectively connected in parallel to the third head block 503, the second head block 502 and the first head block 501.

MODIFICATION EXAMPLE 2

Figure 11:
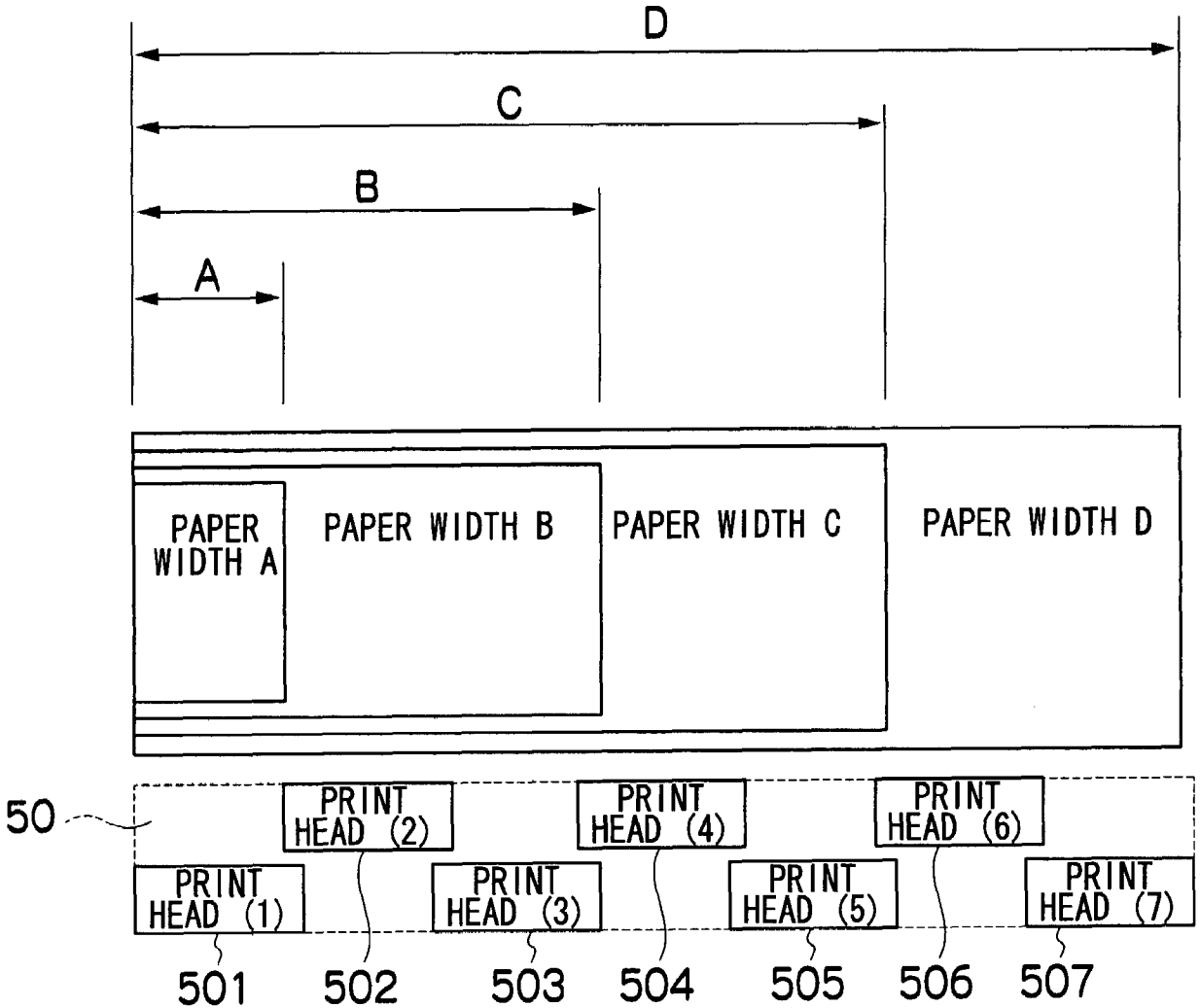
FIG. 11 is a schematic plan diagram of a further example showing the relationship between the print head structure and the recording medium.

Instead of the center-based alignment system illustrated in FIG. 2, it is also possible to adopt a side-alignment system as illustrated in FIG. 11, in which respective recording media of different widths are aligned substantially at one lateral side edge thereof, and are conveyed in this aligned state. According to this composition, the first head block 501 disposed at one reference end position of the recording medium (the left-hand end in the diagram) has a nozzle row of a length corresponding to the minimum paper width A, and when printing onto a recording medium of width A, ink is ejected from the first head block 501 only. Furthermore, since a nozzle row of a length corresponding to the paper width B is achieved by a combination of the first head block 501 and the second and third head blocks 502, 503, then, when printing onto a recording medium of width B, only the first to third head blocks 501 to 503 are used. Similarly, when printing onto a recording medium of width C, only the first to fifth head blocks 501 to 505 are used, and when printing onto a recording medium of width D, ink is ejected from all of the head blocks 501 to 507.

If the use frequency is "paper width A>paper width B>paper width C>paper width D", then the ejection frequency of the first head block 501 is the highest, and the ejection frequency subsequently declines at the second and third head blocks 502 and 503, and at the fourth and fifth head blocks 504 and 505, while the sixth and seventh head blocks 506 and 507 have the lowest ejection frequency.

Figure 12:
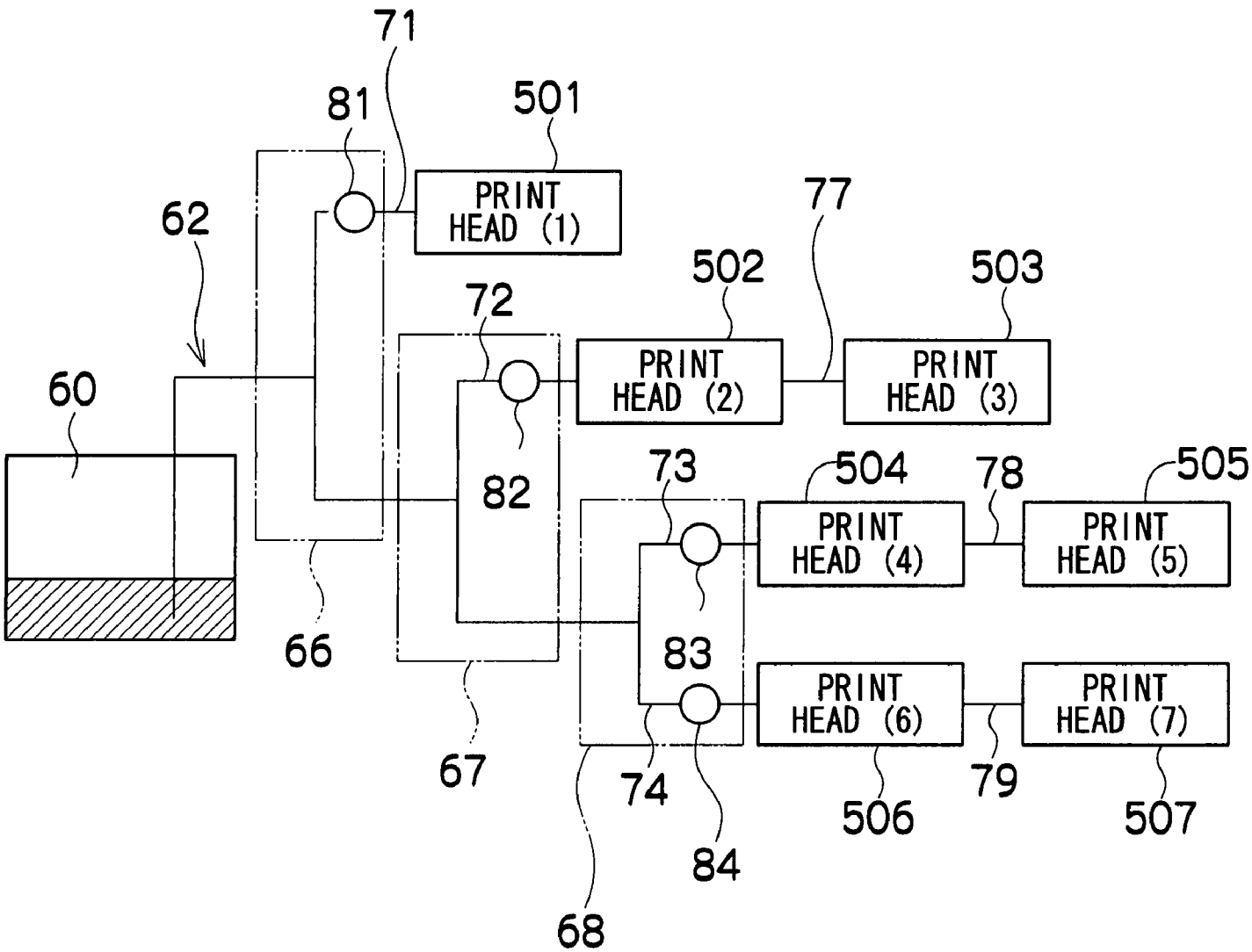
FIG. 12 is a schematic piping diagram of an ink supply system corresponding to the composition in FIG. 11.

FIG. 12 shows a schematic drawing of the piping of an ink supply system corresponding to the composition shown in FIG. 11. Compared to FIG. 6, in the piping structure shown in FIG. 12, the blocks connected to the branch pipes 71 to 74 are changed in accordance with ranking of the ejection frequency of the head blocks 501 to 507. In FIG. 12, items which are the same as or similar to those in FIG. 6 are labeled with the same reference numerals and description thereof is omitted here.

Figure 13:
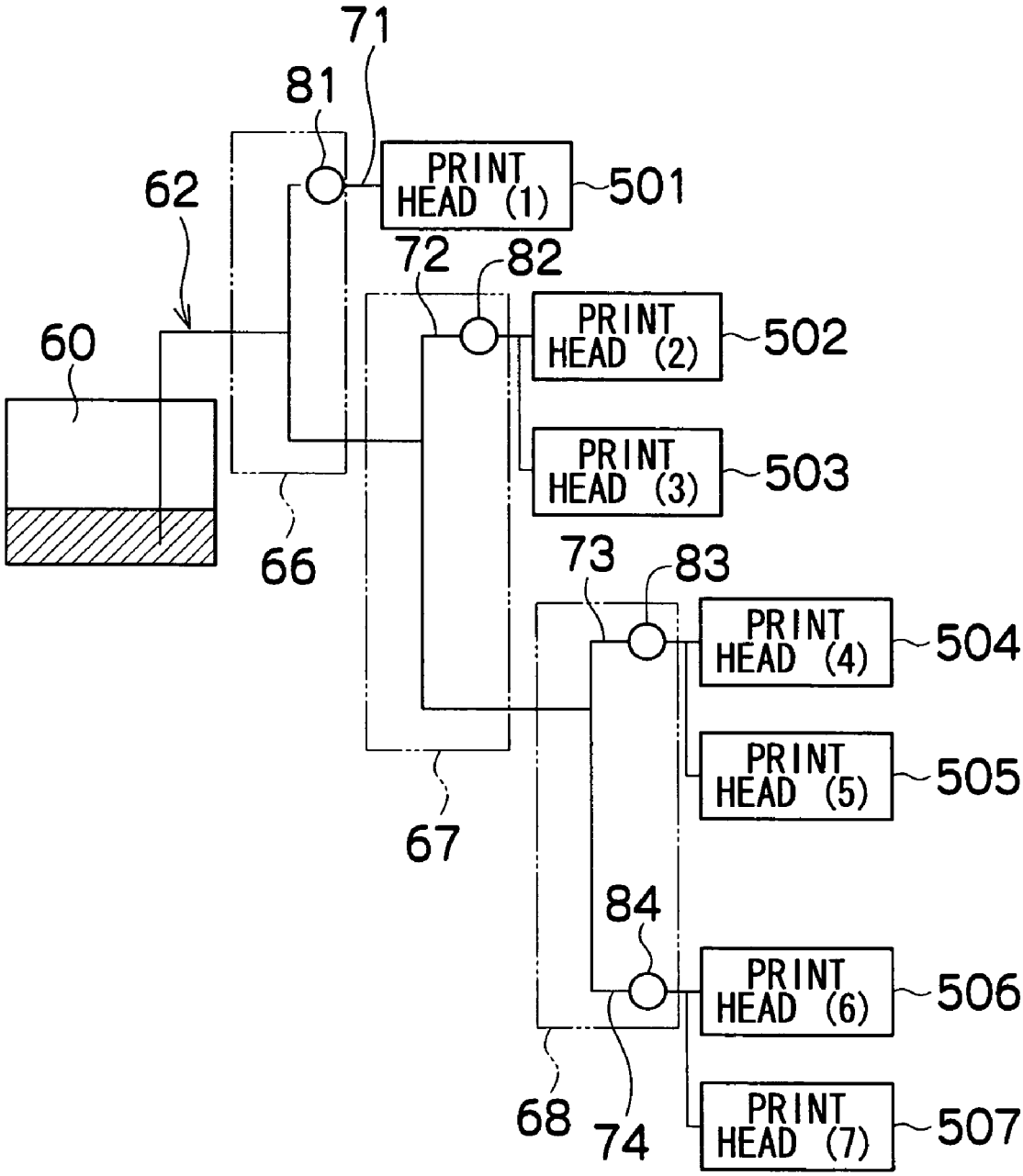
FIG. 13 is a schematic piping diagram showing a further compositional example of an ink supply system corresponding to the composition in FIG. 11.

Furthermore, similarly to the fact that the composition in FIG. 10 can be adopted instead of that in FIG. 6, instead of the piping structure in FIG. 12, it is also possible to adopt a mode as illustrated in FIG. 13, in which the second head block 502 and the third head block 503 are connected in parallel, and the fourth and fifth head blocks 504 and 505, and the sixth and seventh head blocks 506 and 507, are also respectively connected in parallel.

Moreover, in the foregoing explanation, an inkjet recording apparatus was described as one example of an image forming apparatus, but the scope of application of the present invention is not limited to this. For example, the liquid supply device according to the present invention may also be applied to a photographic image forming apparatus in which developing solution is coated onto a printing paper by means of a non-contact method. Furthermore, the scope of application of the liquid supply device according to the present invention is not limited to an image forming apparatus, and the present invention may also be applied to various other types of apparatuses which spray a processing liquid, or other liquid, toward an ejection receiving medium by means of an ejection head (such as a liquid ejection device, coating device, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid supply device which supplies ejection liquid to a plurality of ejection heads from a liquid tank, comprising:

a supply pipe which connects the liquid tank to the plurality of ejection heads, an upstream end portion of the supply pipe being connected to the liquid tank, a downstream side of the supply pipe being branched into a plurality of branch pipes having different numbers of branches by means of a plurality of ramifying sections, ends of the plurality of branch pipes being respectively connected to the plurality of ejection heads; and a flow path resistance altering device which alters a flow path resistance in at least one of flow paths from the plurality of ramifying sections to the plurality of ejection heads, wherein branch pipes having a relatively small number of branches among the plurality of branch pipes are connected to ejection heads having a relatively high ejection frequency among the plurality of ejection heads.

2. The liquid supply device as defined in claim 1, wherein:

each of the plurality of ejection heads has a plurality of nozzles forming liquid ejection ports; and a line head having a long nozzle row is constituted by aligning the plurality of ejection heads.

3. The liquid supply device as defined in claim 1, wherein the branch pipe having a smallest number of branches by means of the ramifying sections among the plurality of branch pipes is connected to the ejection head having a highest ejection frequency among the plurality of ejection heads.

4. The liquid supply device as defined in claim 3, wherein:

each of the plurality of ejection heads has a plurality of nozzles forming liquid ejection ports; and a line head having a long nozzle row is constituted by aligning the plurality of ejection heads.

5. The liquid supply device as defined in claim 4, wherein the ejection head having the highest ejection frequency is disposed in a central portion of an arrangement of the plurality of ejection heads forming the line head.

6. The liquid supply device as defined in claim 4, wherein the ejection head having the highest ejection frequency is disposed in one end portion of an arrangement of the plurality of ejection heads forming the line head.

7. The liquid supply device as defined in claim 1, further comprising:

a pressure measuring device which is arranged in the branch pipe after a branch by means of the ramifying section and upstream of the ejection head; and a flow path resistance control device which controls the flow path resistance altering device according to a measurement result of the pressure measuring device in such a manner that supply pressures of the plurality of ejection heads are substantially equal to each other.

8. The liquid supply device as defined in claim 7, wherein the flow path resistance control device controls the flow path resistance altering device so as to close at least one of the flow paths to at least one of the plurality of ejection heads that is not ejecting the liquid.

9. The liquid supply device as defined in claim 1, wherein the flow path resistance altering device comprises a mechanism which alters a cross-sectional area of a pipe forming the flow path.

10. An image forming apparatus comprising the liquid supply device as defined in claim 1, the image forming apparatus forming an image on a recording medium by means of the liquid ejected from the ejection heads.

11. The image forming apparatus as defined in claim 10, further comprising a flow path resistance control device which functions as a recording density correction device which suppresses variation in recording density between the plurality of ejection heads by controlling the flow path resistance altering device so as to adjust a supply pressure at each of the plurality of ejection heads.

* * * * *